United States Patent [19]

Ohtsuki et al.

[11] Patent Number: 4,747,755

[45] Date of Patent: May 31, 1988

[54] CAPACITY CONTROL DEVICE FOR A SCREW COMPRESSOR

[75] Inventors: Akira Ohtsuki; Kaname Otsuka; Osamu Hikita, all of Settu, Japan

[73] Assignee: Daikin Industries, Ltd., Osaka, Japan

[21] Appl. No.: 787,089

[22] Filed: Oct. 15, 1985

[30] Foreign Application Priority Data

Oct. 12, 1984 [JP] Japan ..... 59-214667

[51] Int. Cl.[4] ..... F04B 49/02; F04B 49/08; F04C 29/08

[52] U.S. Cl. ..... 417/282; 417/290; 417/310; 418/14; 418/195

[58] Field of Search ..... 417/310, 440, 282, 290; 418/201, 195, 14

[56] References Cited

U.S. PATENT DOCUMENTS 4,342,199 8/1982 Shaw et al. ..... 417/310
4,534,719 8/1985 Zimmern ..... 418/195

FOREIGN PATENT DOCUMENTS 57-206794 12/1982 Japan ..... 418/201
1335024 10/1973 United Kingdom ..... 418/201

*Primary Examiner*—John J. Vrablik
*Attorney, Agent, or Firm*—Stevens, Davis, Miller & Mosher

[57] ABSTRACT

A capacity control device for a screw compressor provided with a capacity control passage and a slide valve adjusting the opening thereof, wherein the slide valve is driven in a closing direction due to a pressure difference between a high pressure and a low pressure and is moved in an opening direction thanks to function of a spring when the high pressure is balanced with the low pressure, and when the pressure difference between the high pressure and low pressure is lower to cause the slide valve to be open thanks to the function of the spring, the slide valve is moved in the closing direction against the spring by use of pressure in a compression-processing part in the screw compressor, thereby enabling to quickly transit from no load condition to a loaded condition.

5 Claims, 5 Drawing Sheets

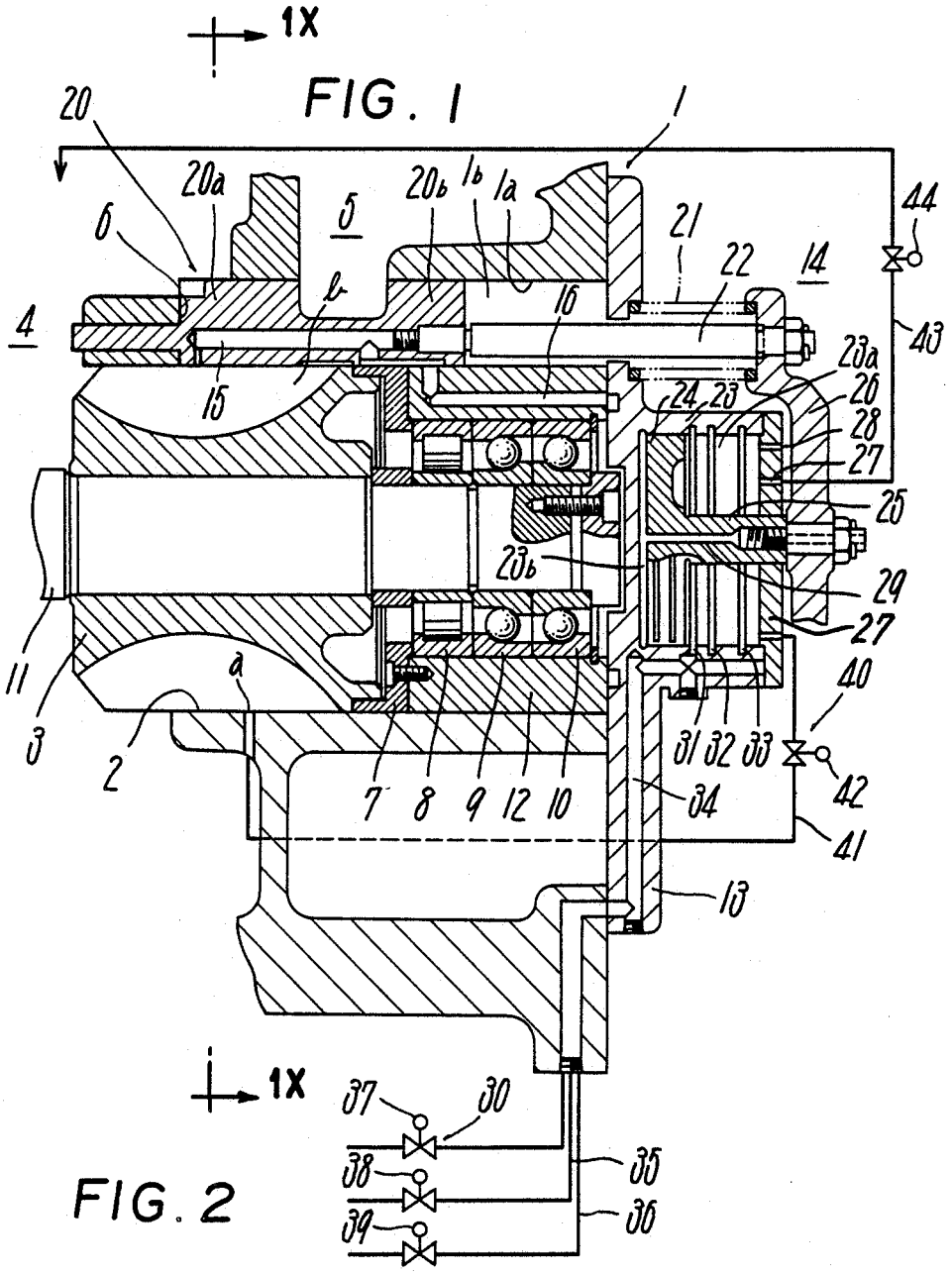
1X
FIG. 1
20
1
20a
20b
1b
1a
5
6
4
b
16
21
22
14
44
43
23a
20
24
23
28
27
25
15
23b
29
27
11
3
a
2
7
8
9
12
10
31
32
33
40
42
34
41
13
1X
37
30
38
35
39
36
FIG. 2
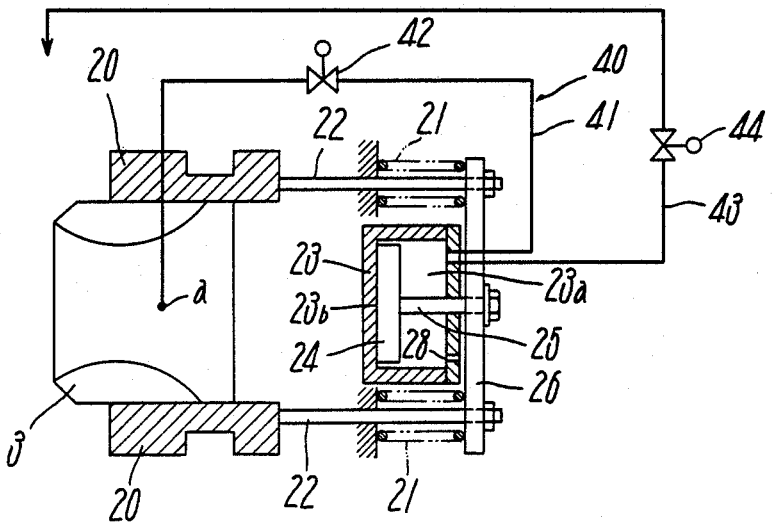
42
20
40
41
44
22
21
43
23
23a
a
23b
28
25
24
26
3
20
22
21

CAPACITY CONTROL DEVICE FOR A SCREW COMPRESSOR

FIELD OF THE INVENTION

This invention relates to a capacity control device for a screw compressor or more particularly to a capacity control device having a capacity control passage which provides capacity control by communicating the high pressure side with the low pressure side in the screw compressor and a slide valve which controls the opening of said passage and arranged to drive said slide valve by the pressure difference between the high pressure and low pressure.

BACKGROUND OF THE INVENTION

As shown in FIG. 8, illustrating the prior art, a capacity control device which provides capacity control by shifting a slide valve(V) under the pressure difference between the high pressure side and low pressure side in the compressor is previously well known as described in Unexamined Japanese Patent Application No. Sho 57-137637. As shown in FIG. 8, said capacity control device comprises said slide valve (V) which is freely slidably mounted on the compressor casing(A), and a cylinder(C) housing a piston (P) which cylinder is provided on the outside of said casing(A), said slide valve(V) being connected with the rod(R) of said piston (P), the rod end chamber ($C_1$) and head end chamber($C_2$) of said cylinder (C) being communicated with the high pressure side (HP) in the compressor through communcation holes ($B_1$, $B_2$) respectively, a plurality of escape holes ($H_1$,$H_2$) being provided on said cylinder(C), low pressure side connection pipings ($D_1$,$D_2$) each having solenoid valves($SV_1$, $SV_2$) being connected said escape holes ($H_1$, $H_2$). By releasing the pressure of said rod end chamber (C1) by opening said solenoid valves (SV1, SV2), said slide valve (V) shifts via said piston(P), thus providing capacity control.

Further in this construction, in order to avoid the liquid compression at the start-up of operation and relieve the starting torque, a spring(s) is provided to urge said piston(P) in the right-hand direction in FIG. 8 and position said slide valve (V) in the right-hand direction in FIG. 8 for fully opening of capacity control passage(E). Therefore, when the high pressure side (HP) and low pressure side (LP) are balanced, said slide valve(V) is located in the right-hand direction by dint of said spring(s) and said capacity control passage(E) is fully opened.

Furthermore, the right end surface of said slide valve(V) in FIG. 8 is exposed to the discharge operation side to thereby be subjected to high pressure and the left end surface is exposed to said capacity control passage(E) and subject to the low pressure.

In FIG. 8, the righthand side of casing (A), i.e., the outside part of casing (A) where cylinder (C) is arranged, is a continution of the discharge chamber and is subject to discharge pressure.

When said solenoid valves(SV1, SV2) are both closed, the rod end chamber (C1) and head end chamber(C2) are charged to the high side pressure and said slide valve(V) shifts in the left direction under the difference in pressure acting on both pressure bearing surfaces thereof and completely close said capacity control passage(E), thereby enabling 100% loading operation. Further, by successively opening said solenoid valves (SV1),(SV2), the pressure in said rod end chamber(C1) is lowered and said piston(P) shifts in the right direction overcoming a force of the difference in pressure acting on both pressure bearing surfaces of said slide valve(V) and stops at the location closing said escape holes(H1), (H2). Therefore, said slide valve (V) moves along with the movement of said piston(P) to thereby stepwise open the capacity control passage(E), thereby enabling 66%, 33% loading operation.

With the conventional capacity control mechanism shown in FIG. 8, since said valve(V) is fully opened, at the start-up, by the action of said spring(s), pressure difference between the high pressure and low pressure side sufficient to overcome the force of said spring(s) is necessary to transit from no loading operation (10% or 15% capacity) at the starting to a minimum loading operation for example 25% or 30% capacity. However, such pressure difference is not rapidly available. Therefore, the conventional mechanism has a problem of slow start-up for loading operation.

For example, in case of heat-pump type refrigeration system using a 4 way change-over valve actuated driven by the high side and low side pressure difference as an acting force, this problem may result in the failure or malfunction of said 4 way change-over valve's operation. For this reason, it is necessary, upon employment of the 4 way change-over valve, to provide additional means to ensure said valve operation under a low pressure difference condition. In order to speed up the rise in differential pressure at the start-up, the use of an oil hydraulic pump is conceivable to generate pressure higher than the discharge pressure at the start-up for applying this higher pressure on said piston(P) and thereby forcibly moving said piston(P) to thereby raise up the load. However, an oil hydraulic pump required separately is not desirable especially with a screw compressor where compactness is an important requirement, and constitutes disadvantages in respect of cost and reliability. Therefore, this idea does not provide a complete solution of said problem.

In studying the pressure distribution within the screw compressor under no loading condition (low differential pressure condition) at start-up as shown in FIG. 7, the following fact has been found. Since the discharge side and capacity control passage (E) communicate with each other via the screw rotor, the pressure should be the same all over the screw rotor. This is true statically. However, dynamically because of the refrigerant gas flow in the screw rotor, the in-process pressure (PM) in the compression process is higher than discharge pressure(PD). For instance, when measuring the groove pressure in the screw rotor at the casing, in case of suction pressure(PS) 10 kg/cm$^2$, an in-process pressure (PM) of 11.5 kg/cm$^2$ was obtained, which was 1.5 kg/cm$^2$ higher than discharge pressure (PD) of 10 kg/cm$^2$ (same as PS).

Though this value is slightly affected by the low pressure side condition and location of stoppage of slide valve, the following approximate formula applies between in-process pressure (PM) and suction pressure (PS)

$$PM \approx C \times PS$$

Based upon said measured values and conversion factor 1.03, said constant (C) becomes 1.14.

SUMMARY OF THE INVENTION

The objective of this invention is to take out said in-process pressure (PM) from the inside of said screw compressor, noting that said in-process pressure (PM) is higher than discharge pressure (PD) and make possible the operation of said slide valve even under low or no differential pressure condition by utilizing said in-process pressure without the use of an oil hydraulic pump at the start-up of operation, thereby speeding up the rise in loaded operation.

The invention is a capacity control device for a screw compressor, wherein there are provided the following constructions.

(a) a capacity control passage for making a capacity control by bypassing a gaseous fluid in process of compression in the screw compressor, which has a suction chamber and a discharge chamber, to the suction chamber, (b) a slide valve which adjusts opening of the capacity control passage and comprises a high-pressure-side pressure bearing surface in communication with the discharge chamber and a low-pressure-side pressure bearing surface in communication with the suction chamber, so that the slide valve is moved in the closing direction due to a pressure difference between the high pressure and low pressure each acting on said pressure bearing surfaces respectively, (c) a spring which urges the slide valve in the opening direction, (d) an operating means for controlling positions of the slide valve in the opening direction which slide valve being moved to the closing position due to the pressure difference between the high pressure and low pressure, the operating means comprising an actuation chamber, an escape passage open to the actuation chamber to communicate the actuation chamber with the suction chamber, and an opening-closing means for opening and closing the escape passage, and (e) a control means which, when the pressure difference between the high pressure and low pressure is lower to cause the slide valve to be open due to function of the spring, moves the slide valve in the closing direction against the spring to thereby control a transition from no load condition to a loaded condition, the control means is provided with a communication passage which communicates the actuation chamber with a compression-processing part in the screw compressor near a discharge port and allowing pressure at the compression-processing part to be applied to the actuation chamber and thereby moving the slide valve in the closing direction.

Thus, according to the invention, at the start-up of operation, even when the slide valve is fully open due to the function of spring to thereby lead to no load condition (Low differencial pressure condition), transition from the no load condition (Low differential pressure condition) to a loaded condition can be made quickly.

In detail, since this invention is constructed so that gas refrigerant of the in-process pressure is derived from the compression-processing part in the compressor located near the discharge port to forcibly shift the slide valve, it becomes possible to close the capacity control passage by the slide valve even when there is no or slight differential pressure condition at the start-up, and rapidly raise the differential pressure and thereby speed up the transition from no load operation to a loaded operation.

Therefore, even in case of using a differential pressure operated 4-way change-over valve in a refrigeration unit, it is always possible to smoothly operate said 4-way change-over valve without the malfunction thereof.

Further, since the in-process pressure of the compressor is utilized, no oil hydraulic pump is necessary for shifting said slide valve(20), which advantageous to the compactness, cost and reliability of the unit. Specific advantages of the invention will be made more apparent by the detailed description of the embodiments of the invention according to the attached drawings.

BRIEF DESCRIPTION OF THE DRAWINGS

FIG. 1 is a sectional drawing showing Embodiment No. 1 of this invention,

FIG. 2 is a schematic drawing explaining said embodiment,

DESCRIPTION OF THE PREFERRED EMBODIMENTS

Figure 9:
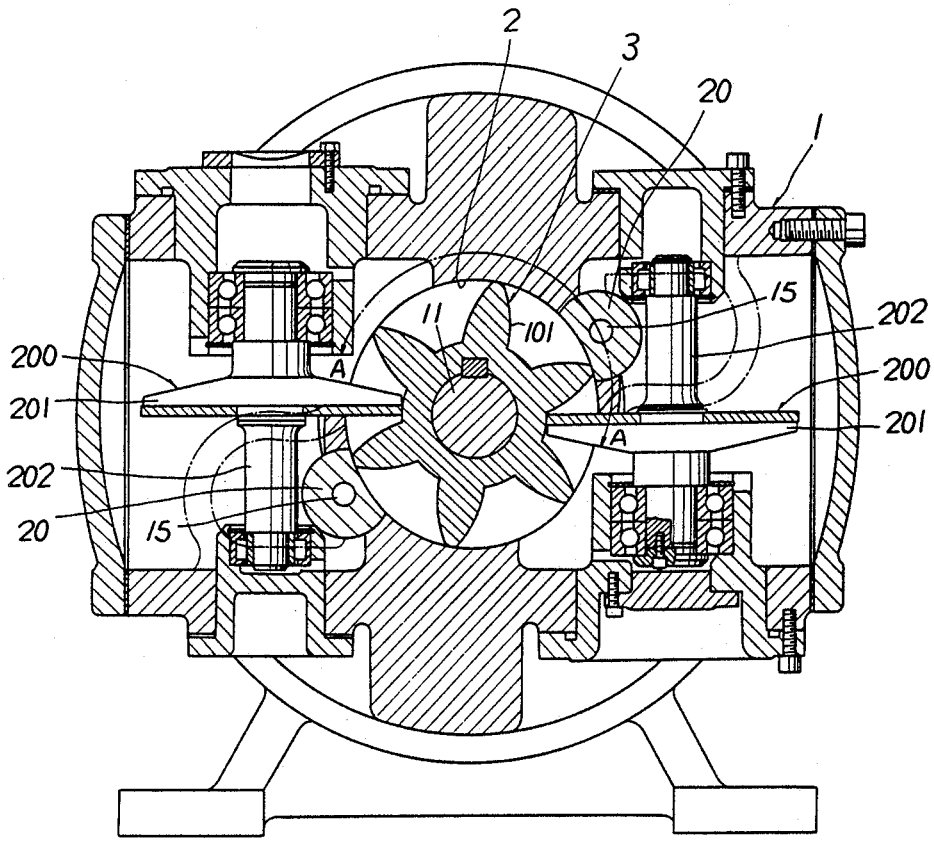
FIG. 9 PRIOR ART
FIG. 9 is a cross-sectional view taken along lines IX—IX of FIG. 1, illustrating the prior art.

FIG. 9 is a sectional view of a prior art compressor of the type as disclosed in U.S. Pat. No. 4,534,719. As shown in FIG. 9 gate rotor (200) is provided at its outer periphery with a plurality of teeth (201) and at the central part with a rotary shaft (202). A gate rotor (200') is arranged about 180 degrees out of phase from gate rotor (200), at a location radially outward of screw rotor (3) and circumferentially displaced from the slide valve (20). The teeth (201), (201') of gate rotors (200), (200'), respectively, are in mesh with the screw groove (101) at the screw rotor (3) to thereby close the screw groove (101) so as to form a compression space.

Figure 10:
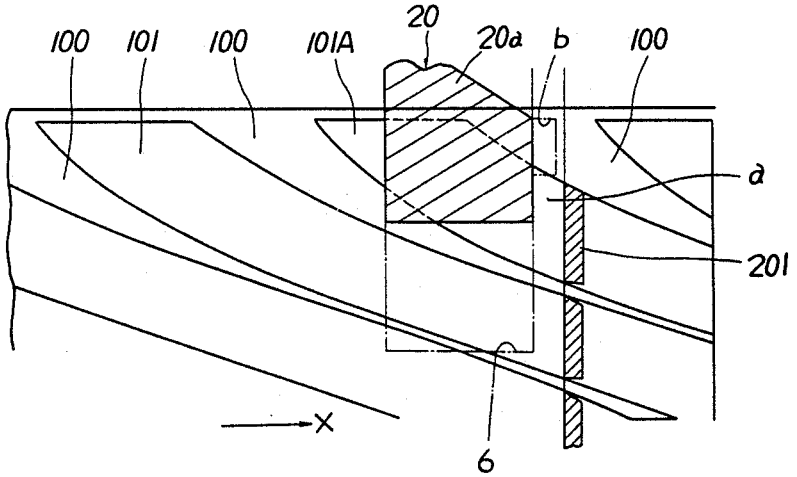
FIG. 10 is a schematic representation of a stretched view along section A—A of FIG. 9.

The location where the connection passage (41) is specially connected with the casing (1) is at a location near the discharge port, which communicates with the discharge chamber (5), i.e., the location indicated by reference (a) of FIG. 10.

The stretched view (FIG. 10) is made along line A—A extending between the gate rotors (200), (200') of FIG. 9. Screw ridge (100) and the screw groove (101) of screw rotor (3) appear in stretched out view in FIG. 10. Rotation of screw rotor (3) is made in the direction of arrow X as shown in FIG. 10. In the rotation direction (i.e., at the right side of FIG. 10) are arranged the capacity control passage (6) and the first land (20*a*) of slide valve (20) which controls opening and closing of passage (6). FIG. 10 illustrates the state of operation where the slide valve (20) fully opens passage (6).

Discharge port (b) is located alongside slide valve (20) forward, in the rotating direction of rotor (3), of slide valve (20).

Gate rotors (200), (200') are located forward, in the rotating direction of rotor (3), of the discharge port (b) and the teeth (201), (201') of rotors (200), (200') are fitted into the screw groove (101) to thereby close the same.

As illustrate in the lower portion of FIG. 10 the capacity control passage (6) exists in the suction chamber (4) and as the screw groove (101) shifts toward the right of FIG. 10, following the rotation of rotor (3), the screw groove (101) is closed by teeth (201), (201') of gate rotors (200), (200') to thereby compress gas refrigerant.

As shown in FIG. 10, screw groove (101A) is open to the capacity control passage (6) simultaneous when a part of discharge port (b) is open to screw groove (101A). In such an instance, as rotor (3) rotates, the opening of discharge port (b) to screw groove (101A) increases, while the opening of capacity control passage (6) to the screw groove (101A) decreases until ultimately opening of the screw groove (101A) to capacity control passage (6) vanishes. Because the original opening area of the capacity control passage (6) is larger than that of discharge port (b) there occurs a range in the course of the increase and decrease of the aforesaid opening of port (b) and passage (6) to the groove (101A) that the sum of the specific areas of said opening of the discharge port (b) and the passage (6) with regard to screw groove (101A) is at a minimum and simultaneously the volume of screw groove defined by gate rotor (200) is in the course of reduction. In this sequence, gas refrigerant is compressed to a given pressure.

Thus, in a state of no-load, pressure in the aforementioned sequence becomes larger than the discharge pressure (PH) and suction pressure (PL). This phenomenon itself occurs in the prior art compressors as represented by the device disclosed in U.S. Pat. No. 4,534,719. However, the inventors of the present invention recognize this phenomenon, calling the increased pressure, which is higher than the discharge and suction pressures (PH), (PL), respectively, the "in-process pressure (PM)." Moreover, the present inventors have set the location of the connection of the connection passage (41) within the location of the compression processing part of the device as designated by reference (a).

(EMBODIMENT NO. 1)

FIG. 1 shows a single screw compressor for use in refrigeration units. A screw rotor (3) is freely rotatably mounted on a cylindrical inner wall(2) of a casing(1) and a pair of gate rotors (not shown) are meshed with said screw rotor (3). By rotation of each rotor, low pressure gaseous refrigerant is taken into the compressor from a suction chamber(4) and compressed in the space enclosed by said cylindrical inner wall(2) and each rotor and discharged from a discharge chamber(5) through a discharge port (b).

The casing(1) is provided, approximately in the middle portion of the cylindrical inner wall(2), with a capacity control passage(6) which bypasses gas refrigerant in compression process to the suction chamber(4) and communicates the high pressure side communicating with the discharge chamber(5) with the low pressure side communicating with the suction chamber(4), so that the capacity control can be made by adjustment of the opening of the capacity control passage(6).

Meanwhile, in FIG. 1, numeral(7) is an inner sealing ring, numerals (8),(9), and (10) bearings supporting a drive shaft(11) of said screw rotor(3), numeral (12) an outer ring which fixed at the outside of the casing(1) and holds in association with said inner ring(7) outer races of said bearings (8),(9) and (10), and numeral (13) a cover plate attached to said casing (1).

In a screw compressor above constructed, the capacity control device of Embodiment No. 1 as shown in FIG. 1 comprises a slide valve (20) which controls opening of said capacity control passage (6), a spring (21) which urges said slide valve(20) in the opening direction, an operating means(30) for controlling positions of the slide valve(20) in the opening direction which slide valve being moved to the closing position due to the pressure difference between the high pressure and low pressure, and a control means (40) which, when a differential pressure between the high pressure and low pressure is lower to cause the slide valve(20) to be open due to function of the spring(21), moves the slide valve(20) in the closing direction against the spring(21) to thereby control a transition from no load condition (Low differential pressure condition) to a loaded condition.

A pair of slide valves (only one of which is illustrated at (20)) are usually employed, being of the two-lands type, and the first land(20*a*) controls the opening of said passage (6). The slide valve(20) is freely slidably mounted on a hole(1*a*) provided in said casing(1). The end surface of said first land (20*a*) is exposed to said suction chamber(4) so as to serve as the low-pressure-side pressure bearing surface and the end surface of the second land(20*b*) is exposed to a back chamber(1*b*), which communicates with said discharge chamber(5), so as to serve as the high-pressure-side pressure bearing surface. By the difference in pressure acting on both end surfaces, i.e., the pressure bearing surfaces, said slide valve(20) shifts in the left direction and completely closes said passage(6).

Further, said slide valve(20) is provided with a rod(22) which pierces said cover plate(13), extends to an outer chamber (14) of high side pressure and is connected, through a connection piece(26), with a rod(25) of the piston(24) housed in a cylinder (23) provided on said cover plate(13). Said spring(21) is interposed between said cover plate(13) and said connection piece(26). A rod end chamber(23*a*) of said cylinder(23) communicates with the discharge chamber(5) through an equalizing hole(28) provided on a cylinder cover (27), and a head end chamber(23*b*) also communicates with the discharge chamber(5) through an equalizing hole(29) provided on said piston(24) and rod (25). In other words, through each equalizing holes(28),(29), both said rod end chamber(23*a*) and head-end chamber(23*b*) are equally pressurized under the high side pressure. With respect to said piston(24) only, since the pressure-acting surface thereof in said rod end chamber(23*a*) is smaller by the rod sectional area than that in said head end chamber(23*b*), said piston(24) tends to shift in the right direction thanks also to the biasing force of said spring(21).

Next, the explanation will be given on the operating means (30) which controls the position of the slide valve(20). The operating means(30) in FIG. 1 comprises 3 escape holes(31),(32), (33) which provided on the wall of the cylinder (23). 3 escape passages (34),(35),(36) each communicating with the suction chamber(4) are connected with the escape holes (31)–(33) respectively, and 3 solenoid valves(37),(38), (39) serving as opening-closing means are provided on each escape passages (34)–(36).

While, among the escape passages(34)–(36), only the escape passage(34) is illustrated in FIG. 1, the passages(34)–(36) are formed by utilizing the wall of the cylinder(23), cover plate(13) and casing (1), and the solenoid valves(37)–(39) provided on the passages (34)–(36) are each mounted on pipings each connected to each passage(34)–(36).

Furthermore, the escape holes(31)–(33) are provided on the rod end chamber(23*a*) to be each displaced in the sliding direction of the piston(24) and the locations of these escape holes determine the opening positions of said slide valve(20). Therefore, for a 50% capacity control, an escape hole shall be provided in the middle of the stroke of said piston (24) and for a 75% and 25% capacity control, escape holes shall be provided at the location of ¾ and ¼ of said stroke.

Further, said solenoid valves(37)–(39) are used together with sensors sensing such as refrigerant temperature, refrigerant pressure and room air temperature and is operated for opening and closing by a controller actuated through output of said sensors. Further, for 100%, 70% and 40% capacity control, it is preferable to provide two sets of escape hole, escape passage and solenoid valve.

Next, explanation will be given on the control means(40) which is the key part of this invention.

As schematically shown in FIG. 2, Embodiment No. 1 of FIG. 1 is constructed so that the rod end chamber(-23*a*), that is, the high-pressure side actuation chamber which shifts said slide valve (20) in the closing direction communicates, through a connection passage (41) consisting of piping, with a compression-processing part (a) located near the discharge port of screw compressor, a solenoid valve(42) serving as an opening-closing means is mounted midway on the connection passage(41), and there is provided in association with the connection passage(41) and valve (42) a low pressure side piping (43) which communicates the rod end chamber(23*a*) with the suction chamber(4) side and is provided with a solenoid valve(44) serving as an opening-closing means.

Since the compression processing part(a) located near the discharge port is the part where an in-process pressure higher than discharge pressure is obtainable, gas refrigerant under the in-process pressure is introduced, through said connection passage (41), into said rod end chamber(23*a*) by closing the solenoid valve(44) and opening said solenoid valve(42), whereby forcibly shifting said piston(24) in the left direction, that is, moving said slide valve(20) in the closing direction.

Further, said solenoid valve(42) is opened, by use of a timer, 30 minutes after the start-up when liquid refrigerant in the casing(1) is completely discharged by the rotation of said screw rotor (3). Said solenoid valve(44) is also closed by use of a similar timer, 30 minutes after the start-up.

Meanwhile, numerals (15) and (16) of FIG. 1 are lubrication-oil supply grooves provided on said slide valve(20) and casing (1).

Next, explanation will be given on the operation of the capacity control device constructed as abovesaid.

FIG. 1 shows the state where said slide valve(20) completely closes said passage(6) and the compressor is operated under 100% loading. In this case, said solenoid valves(37)–(39) and solenoid valve(42) are all closed and the rod end chamber(23*a* ) and head end chamber(23*b*) of said cylinder (23) are held at the high side pressure and the slide valve(20) is held at the completely closed position, being pushed in the left direction under the pressure difference between high side and low side pressure acting on each of said pressure bearing surfaces of said slide valve(20) and overcoming the force of said spring (21). When the load decreases under this condition and said sensors operate, said solenoid valve (37) is opened by the signal from said controller. Since said escape passage(34) is released to the low pressure side by the opening of solenoid valve(37), said rod end chamber(23*a*) is charged at low side pressure and said piston(24) shifts in the right direction to open said slide valve(20).

The amount of said shift of piston is determined by the location of said escape hole (31). That is, when said escape hole(31) is closed by the shift of said piston(24), said rod end chamber(23*a*) is again charged at the high side pressure and said slide valve(20) stops at the location where the biasing force due to the differential pressure acting on both end surfaces of said slide valve(20) becomes balanced with the force of said spring(21). By this stop location of slide valve, the opening of said passage (6) is determined and the capacity control corresponding to this opening, for example, 75% loading operation becomes possible.

When solenoid valves(38) and (39) are opened in the abovesaid state, said slide valve(20) is controlled at the locations determined by the formation locations of said escape holes(32) and (33), the capacity control corresponding to the openings of said slide valve(20), for example, 50% and 20% loading operation becomes possible.

To the contrary, when the load increases, said solenoid valves (37)–(39) are closed successively and by the closing of said solenoid valves, the slide valve(20) is shifted in the left direction so as to increase loaded operation.

Next, explanation will be given on the case of the start-up after the shut-down of the compressor.

In this case, when the high side and low side pressures are balanced by the compressor shut-down, said slide valve(20) shifts in the right direction due to the force of said spring(21) and said passage(6) is completely opened.

Therefore, at the start-up, the operation is close to no load operation of at the most 10% or 15% loading and the pressure difference between high side and low side is none or slight, if any, which is not sufficient to shift said slide valve(20) through overcoming the force of said spring(21).

In case of the start-up from this state, after liquid refrigerant in the casing(1) has been discharged by closing said solenoid valve(42), opening solenoid valve(44) and operating the compressor under no load (the aforesaid no load operation), gas refrigerant under the in-process pressure is introduced into said rod end chamber(-23*a*) through said connection passage(41) by opening solenoid valve(42) of said control means (40) and closing said solenoid valve(44), thereby said piston(24) being forcibly shifted in the left direction through the gas refrigerant's pressure to shift said slide valve(20) in the closing direction.

As stated above, since said rod end chamber (23*a*) can be released to the low pressure side by opening said solenoid valve (44) at the start-up of operation and no load condition can be forcibly established by surely completely opening said slide valve (20) at the start-up, it is possible to surely prevent the compressor from liquid compression at the start-up and surely relieve the starting torque.

Further, since immediate transition to a loaded operation is possible by forcible shift of said slide valve(20) under said in-process pressure, it is possible to obtain rapidly the required pressure difference between the high side and the low side, whereby making it possible to operate a differential pressure operated 4-way change-over valve smoothly and reliably in case said 4-way change-over valve is used in a refrigeration system.

Further said forcible shift of the slide valve(20) under the in-process pressure can be always surely effected regardless of the condition at the start-up.

In this connection, the pressure difference required for the shift of said slide valve(20) will be studied, assuming the suction pressure of 4 kg/cm$^2$ (Case of 0° C. operation) as a possible lowest pressure for the condition of start-up. In this case, a pair of the slide valve(20) having the pressure bearing surfaces of 14 cm$^2$ are used, and the operation surface area of said piston(24) in the rod end chamber(23*a*) is assumed to be 64 cm$^2$. Further, the spring force is assumed to be 7 kg, 10 kg and 15 kg for no loading, 25% loading and 50% loading operation, respectively. As an example, a differential pressure($\Delta P_1$) required to shift said slide valve(20) for transition from no loading operation to 50% loading operation is $\Delta P_1 = 15/14 \times 2 = 0.54$ kg/cm$^2$. Further, a differential pressure ($\Delta P_2$) required to be applied to the operation surface of piston(24) at the rod side to thereby shift said slide valve(20) under no differential pressure condition becomes $\Delta P_2 > 15/64 = 0.23$ kg/cm$^2$.

Meanwhile, the in-process pressure (PM) obtained from the compression-processing part of said compressor becomes based upon thhe suction pressure (PS) of 4 kg/cm$^2$, $$PM = 1.14 \times (4 + 1.03) = 5.73 \text{ abs} = 4.7 \text{ kg/cm}^2\text{g}$$

and the differential pressure between said in-process pressure(PM) and discharge pressure (PD), that is the differential pressure ($\Delta P_2$) acting on the rod-side operation surface of said piston(24) becomes $\Delta P_2 = PM - PD = 4.7 - 4 = 0.7$ kg/cm$^2$, which is sufficient to shift said slide valve(20) in the closing direction. And when a considerable amount of differential pressure sufficient to control said slide valve(20) is developed, said solenoid valve (42) is closed and the ordinary control by means of said solenoid valves (37)–(39) is resumed. As stated above, when it becomes unnecessary to derive the in-process pressure due to the generation of considerable differential pressure, it is effective for the stable operation of said slide valve(20) to kill the pressurizing effect due to said in-process pressure.

Further, said solenoid valves (42) (44) may be replaced by manually operated valves in opening and closing. In case of using such manually operated valves, there is an advantage of being able to easily complete the change-over of a 4-way change-over valve by manually opening and closing operation of said manually operable valves, for example, even in case that the 4-way change-over valve stop during the change-over process.

(EMBODIMENT NO. 2)

Figure 3:
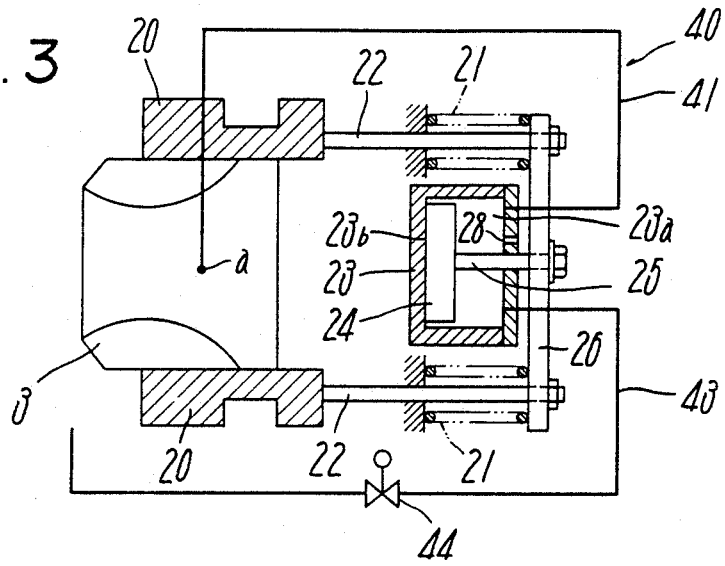
FIG. 3 is a schematic drawing showing the outline of embodiment No. 2.

While above explained Embodiment No. 1 is provided, on said connection passage(41), with a solenoid valve (42), said solenoid valve(42) may be omitted as shown in FIG. 3. In this case, it is possible to conduct a similar control to the explained above by on-off control of said solenoid valve(44) on said low pressure side piping(43).

(EMBODIMENT NO. 3)

Figure 4:
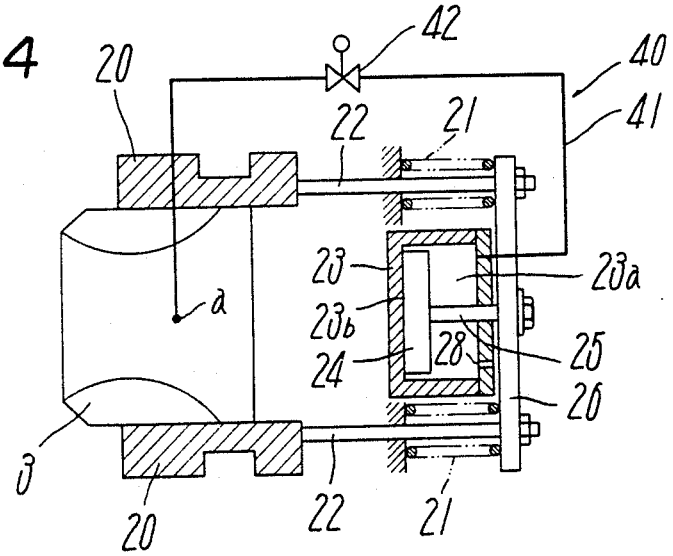
FIG. 4 and FIG. 5 are schematic drawings showing the outline of embodiments No. 3 and No. 4 respectively.

In the embodiment shown in FIG. 4, a low pressure side piping (43) and a solenoid valve(44) of Embodiment No. 1 are omitted. In this case, it is possible to conduct a similar control by on-off control of said solenoid valve(42) only.

(EMBODIMENT NO. 4)

Figure 5:
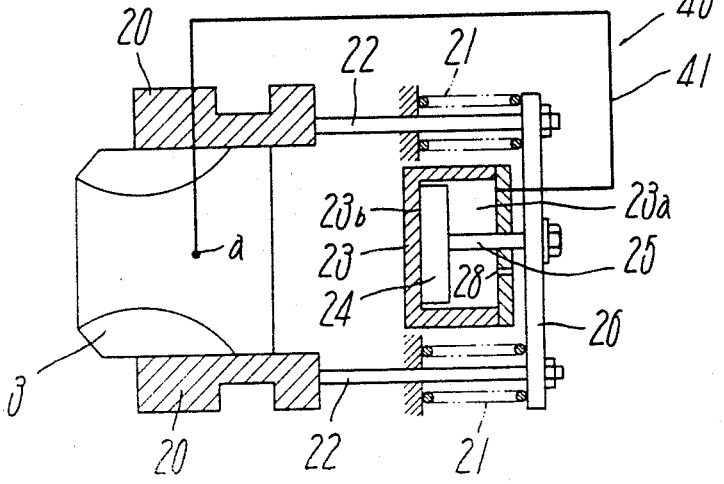

In the embodiment shown in FIG. 5, the solenoid valve(42) of Embodiment No. 3 as shown in FIG. 4 is omitted. In this case, while there is a possibility that the in-process pressure is introduced into the rod end chamber(23*a*) through the connection passage(41) substantially simultaneously with the start-up because of non-existence of solenoid valve(42), it is possible to conduct a similar control to the aforesaid controls by means of this connection passage (41) only.

Further, in this case, a resistance such a capillary tube may be provided on said connection passage(41) to delay the application of the in-process pressure on said rod end chamber(23*a*).

(EMBODIMENT NO. 5)

Figure 6:
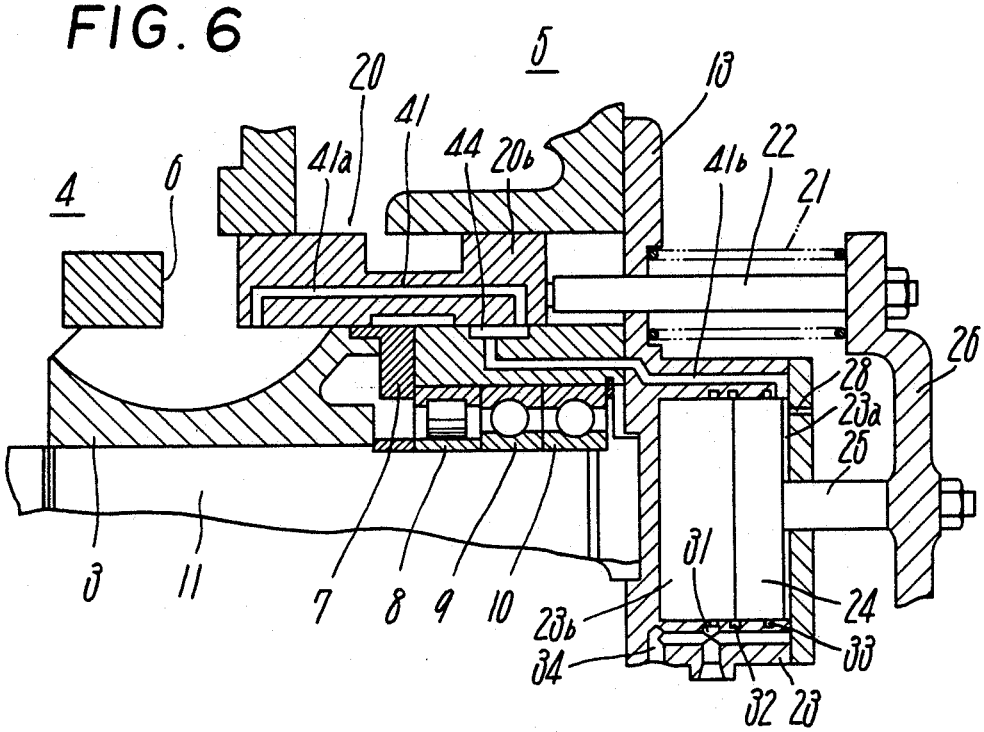
FIG. 6 is a sectional drawing of the principal part of embodiment of No. 5.
Figure 7:
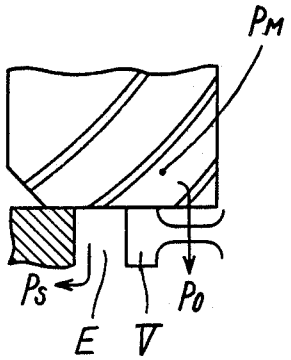
FIG. 7 is an outline drawing showing the location of the in-process pressure generated within the screw rotor under no load condition.
Figure 8:
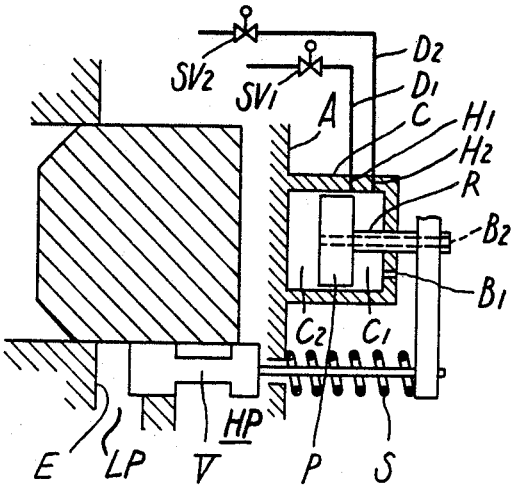
FIG. 8 (PRIOR ART)
FIG. 8 is a sectional drawing of the outline of the prior art.

The embodiment shown in FIG. 6 is constructed so that a connection passage(41) is formed by utilizing said slide valve (20) and casing (1) and a valve mechanism is provided by utilizing said slide valve(20). In this fifth embodiment, said slide valve (20) is provided with a first connection passage(41*a*) which is open to the compression-processing part in the compressor upon full opening of said slide valve(20) and can be open to the casing (1) midway on the second land(20*b*). Said casing(1) is provided with a long groove(44) which confront the opening of said first connection passage(41*a*), and said long groove(44) is connected to said rod end chamber(23*a*) through a second connection passage (41*b*) formed through said casing (1), cover plate(13) and said cylinder (23). Thereby from the full opened location of said slide valve(20) up to an intermediate location where the required differential pressure is available, the first and second connection passages (41*a*)(41*b*) communicate with each other through said long groove(44) and by the shift of said slide valve(20) from said intermediate location in the closing direction, the communication between the first and second connection passages is closed.

With this embodiment like No. 1 and No. 3 embodiments, it is capable to remove the effect of the in-process pressure when deriving of the in-process pressure becomes unnecessary. Also, it is capable to use said slide valve(20) as a valve mechanism without the need of the solenoid valve used in Embodiment No. 1 and No. 3, and it is capable to automatically close the communication of said connection passages(41*a*)(41*b*) when said in-process pressure becomes unnecessary.

Further, while all embodiments above explained are constructed so that a cylinder (23) is provided and a piston (24) housed in said cylinder(23) is connected to said slide valve(20) through a connection member(26), the back end chamber(1b) of said slide valve(20) may be used as the high pressure actuation chamber, in lieu of said rod end chamber (23a), with escape holes (31)–(33) constituting said operating means (30), and the connection passage (41) may be connected with the back end chamber (1b).

Further, while said embodiments are applied to single screw compressors, they are also applicable to double screw compressors.

While exemplary embodiments of the invention have been shown and described, the invention is not limited to the specific constructions thereof, as many modifications can be made within the spirit and scope of the invention which is defined by the following claims.

What is claimed is:

1. A capacity control device for a screw compressor comprising:

(a) a capacity control passage for making a capacity control by bypassing a gaseous fluid in process of compression in said screw compressor, which as a suction chamber and a discharge chamber, to said suction chamber, (b) a slide valve which adjusts opening of said capacity control passage and comprises a high-pressure-side pressure bearing surface in communication with said discharge chamber and a low-pressure-side pressure bearing surface in communication with said suction chamber, so that said slide valve is moved in the closing direction due to a pressure difference between the high pressure and low pressure each acting on said pressure bearing surfaces respectively, (c) a spring which urges said slide valve in the opening direction, (d) an operating means for controlling positions of said slide valve in the opening direction which slide valve being moved to the closing position due to the pressure difference between the high pressure and low pressure, said operating means comprising an actuation chamber, a piston within the actuation chamber to define a first actuation chamber and a second actuation chamber, an escape passage which opens to the first chamber and communicates the first chamber with the suction chamber, an opening and closing means for opening and closing the escape passage, a communicating means communicating the second chamber with the discharge chamber, and a transmitting means for transmitting the movement of the piston to the slide valve, so that the slide valve is moved through the piston and the transmitting means by use of the pressure difference between pressures each acting to the first and second actuation chambers respectively, (e) a control means which, when the pressure difference between the high pressure and low pressure is low causes said slide valve to be open due to function of said spring, moves said slide valve in the closing direction against said spring to thereby control a transition from no load condition to a loaded condition, said control means is provided with a connection passage by which the first actuation chamber is communicated, at a position in the compressor which position is different from a position of the discharge port, with a point in the compression processing part at which point an in-process pressure higher than discharge pressure can be obtained, so that the in-process pressure in the compression processing part is applied to the first chamber so as to move the slide valve in closing direction through the piston and transmitting means by use of the pressure difference between the in-process pressure applied to the first chamber and discharge pressure applied to the second chamber, the connection passage has an opening-closing valve which opens when pressure difference between high pressure and low pressure is low.

2. A capacity control device for a screw compressor according to claim 1, wherein said operating means comprises a cylinder which houses therein a piston and has said actuation chamber, and an interlocking means which associates a motion of said piston with said slide valve, and said escape passage is connected with a wall of said actuation chamber extending along a moving direction of said piston, and said connection passage is connected to said actuation chamber near a terminus of movement of said piston.

3. A capacity control device for a screw compressor according to claim 2, wherein to said cylinder near the terminus of movement of said piston is connected a low pressure passage having an opening-closing means and communicating said actuation chamber with said suction chamber.

4. A capacity control device for a screw compressor according to claim 1, wherein said connection passage is provided with an opening-closing means.

5. A capacity control device for a screw compressor according to claim 1, wherein said slide valve has a first connection passage for communicating said compression-processing part with said actuation chamber, a casing of said screw compressor supporting said slide valve has a second connection passage communicating with said first connection passage when said slide valve is positioned between a full-open position and a predetermined opening position, said second connection passage being connected to said actuation chamber and said first connection passage being open to said compression-processing part.

* * * * *